United States Patent [19]

Pielemeier

[11] 4,048,820

[45] Sept. 20, 1977

[54] RAMPED SCRUBBING VANES FOR AUGER AGITATOR

[75] Inventor: John William Pielemeier, St. Joseph, Mich.

[73] Assignee: Whirlpool Corporation, Benton Harbor, Mich.

[21] Appl. No.: 628,585

[22] Filed: Nov. 4, 1975

[51] Int. Cl.[2] ..... D06F 13/06

[52] U.S. Cl. ..... 68/133; 68/134; 74/126; 259/101

[58] Field of Search ..... 68/131-134, 68/28, 38, 53, 54, 89, 184, 23.6, 23.7; 259/101; 74/126; 192/46; 416/124, 169, 172; 8/159

[56] References Cited

U.S. PATENT DOCUMENTS

| | | | |
|---|---|---|---|
| 1,665,959 | 4/1928 | Graham et al. | 68/133 X |
| 1,897,239 | 2/1933 | Chapman | 68/133 |
| 1,923,580 | 8/1933 | Nelson | 8/159 |
| 2,312,992 | 3/1943 | Scheele | 68/134 |
| 2,331,897 | 10/1943 | Dyer | 68/133 X |
| 2,734,367 | 2/1956 | Geldhof | 68/133 |
| 3,987,651 | 10/1976 | Platt | 68/133 |

FOREIGN PATENT DOCUMENTS

| | | | |
|---|---|---|---|
| 223,751 | 11/1968 | U.S.S.R. | 68/134 |

*Primary Examiner*—Philip R. Coe
*Attorney, Agent, or Firm*—Hill, Gross, Simpson, Van Santen, Steadman, Chiara & Simpson

[57] ABSTRACT

A washer agitator with an oscillating skirt portion below an upper, unidirectionally-rotating auger agitator portion has scrubbing vanes on the skirt ramped on one side so that the fabric such as clothing being washed is driven by the scrubbing vanes in a direction opposite to the direction of orbital fabric movement induced by the rotating auger, thereby minimizing tangling of the fabric during the washing cycle while optimizing roll-over.

15 Claims, 6 Drawing Figures

RAMPED SCRUBBING VANES FOR AUGER AGITATOR

BACKGROUND OF THE INVENTION

1. Field of the Invention

This invention relates to agitating elements for washing machines of the type employing vertical axis agitators formed with unidirectionally-rotating auger portions combined with oscillating skirt portions to provide toroidal movement to the items within the tube of the machine.

2. Description of the Prior Art

It is recognized in the art that a so-called rollover or toroidal movement of fabric such as clothing being washed in a washer is required for uniform washability of loads, and especially for large loads. Such toroidal movement or roll-over consists of movement of the contents of the machine downwardly along the agitator barrel generally parallel to the agitator axis, radially outwardly along the agitator skirt and scrubbing vanes, upwardly along the peripheral wall of the basket, and radially inwardly near the surface of the wash liquid towards the agitator barrel. Good roll-over contributes significantly to good washability and uniformity of washing results.

Agitators which oscillate but which include a helically-vaned member or auger rotating stepwise in a single direction have been found to produce very good roll-over. Such agitators employ an oscillating agitator component having vanes which are symmetrical about a plane passing through the vane and the axis of the agitator, and due to this symmetry (and ignoring the acceleration characteristics of the means for oscillating the agitator), each half stroke of the oscillating agitator component has an equal tendency to rotate the clothes load in the basket. The net result then is that the stroke halves cancel each other in regard to angular rotation of the load. In the conventional agitator, which acts as one piece, this net zero rotation of the clothes load is desirable for producing minimum tangling of the load.

However, in double acting auger agitators employing a unidirectional auger in addition to the oscillating agitator component it has been found that there is a tendency of the auger element to drag the clothes load around in the direction of rotation of the auger element. Experience indicates that this rotation of the load caused by the unidirectional auger contributes heavily to tangling of the load. Load tangling, in turn, leads to high agitator shaft torque, high motor wattage, unbalanced spin loads and unloading problems. Such tangling may also reduce washability and uniformity of washing results, and may even result in damage to the fabrics. Thus, a problem encountered with such agitators has been a tendency toward rotation of the clothes load about the axis of the agitator causing objectionable tangling of clothes within the basket during the washing cycle.

Tangling may be minimized, however, by substantially minimizing rotation of the clothing load about the axis of the agitator. Some opposition to, or counteraction of, such rotation of the basket contents by the auger may be had by varying or adjusting to the clockwise versus the counterclockwise stroke or acceleration characteristics of an oscillating skirt portion of the agitator carrying flat, symmetric vanes. However, such measures are not generally sufficient to overcome the objectionable degree of rotation which can be induced by the auger.

There are many different examples of oscillating agitators in the prior art, and such agitators utilize a variety of different surface configurations. For example, the patent to Graham et al, U.S. Pat. No. 1,665,959, discloses an oscillating agitator element including generally ramp-like surfaces provided with ribs for scrubbing in response to agitator movement in one direction and side surfaces for redistributing the tub contents in response to agitator movement in the opposite direction.

The concept of an oscillating agitator including a unidirectionally-rotating auger is disclosed and claimed in patents assigned to the assignee of the present invention, specifically U.S. Pat. Nos. 3,987,508 (Platt), 3,987,651 (Platt), 3,987,652 (Ruble). However, these structures have not employed the asymmetric scrubbing vanes of the present invention to affect or decrease the net rotation of basket contents about the axis of the agitator caused by the auger.

SUMMARY OF THE INVENTION

In one form of the present invention, an auger portion of an agitator in a vertical axis washing machine is mounted via a one-way clutch for relative unidirectional, stepwise rotation on the agitator barrel and includes at least one helical vane. The skirt portion of the agitator oscillates, and includes generally vertically-disposed, asymmetric scrubbing vanes. Each scrubbing vane includes a ramp portion of the side of the vane facing in the direction of auger rotation, while the side of the scrubbing vane facing opposite to the direction of auger rotation is substantially vertical. Clothes coming in contact with the scrubbing vanes tend to be moved in a net rotational direction opposite that of the auger, tending to slide over the ramped side of each vane in response to vane movement in the auger rotation direction.

Thus, as the agitator oscillates, the unidirectionally rotating auger drives the clothes downwardly along the agitator barrel and urges the clothes in its rotational direction, for example clockwise about the agitator barrel. The asymmetric scrubbing vanes scrub the clothes and move them radially outwardly and in, for instance, a net counterclockwise direction about the agitator barrel. Such a counter-clockwise rotation imparted to the clothes by the ramped scrubbing vanes will tend to substantially offset the clockwise rotation imparted by the auger, resulting in a minimum of clothes tangling and a maximum washability.

The acceleration characteristics of the oscillating skirt portion of the agitator will also affect the net tendency for rotation of clothes about the agitator barrel and may be used to advantage according to the present invention. Utilization of ramped scrubbing vanes in combination with these acceleration characteristics will tend to further minimize the net rotation of basket contents about the axis of the agitator and thus further reduce tangling.

DESCRIPTION OF THE PREFERRED EMBODIMENTS

Figure 1:
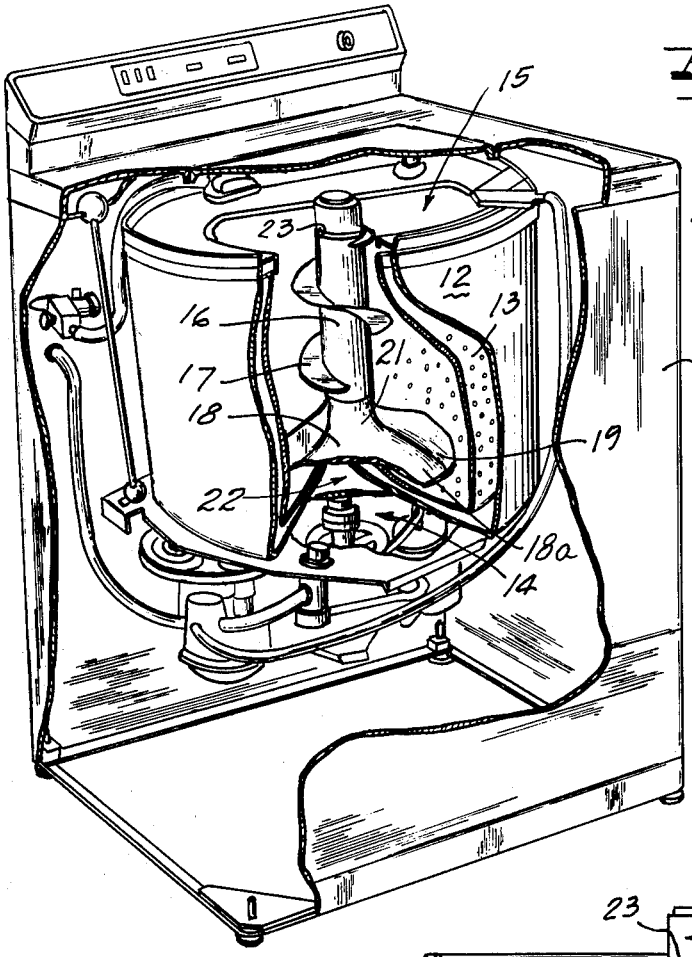
FIG. 1 is a general perspective view of an automatic washing machine incorporating the device of the present invention, with parts of the cabinet and internal components cut away to show additional structural details of the machine.

A washing machine of the vertical axis type is shown generally at 10 in FIG. 1, and has a cabinet 11, a washing liquid tub 12 and a perforated clothes receptacle or basket 13 arranged within the tub and generally coaxially therein. A drive motor and transmission means 14 selectively drives the clothes receptacle 13 and an agitator assembly 15 to carry out the machine cycle. The agitator assembly 15 principally comprises an auger member 16 including at least one helical vane 17 extending radially therefrom and an agitator member 22 including an upstanding barrel portion 21 and a lower skirt portion 18 having upright scrubbing vanes 19 on the upper surface 18*a* thereof.

Figure 2:
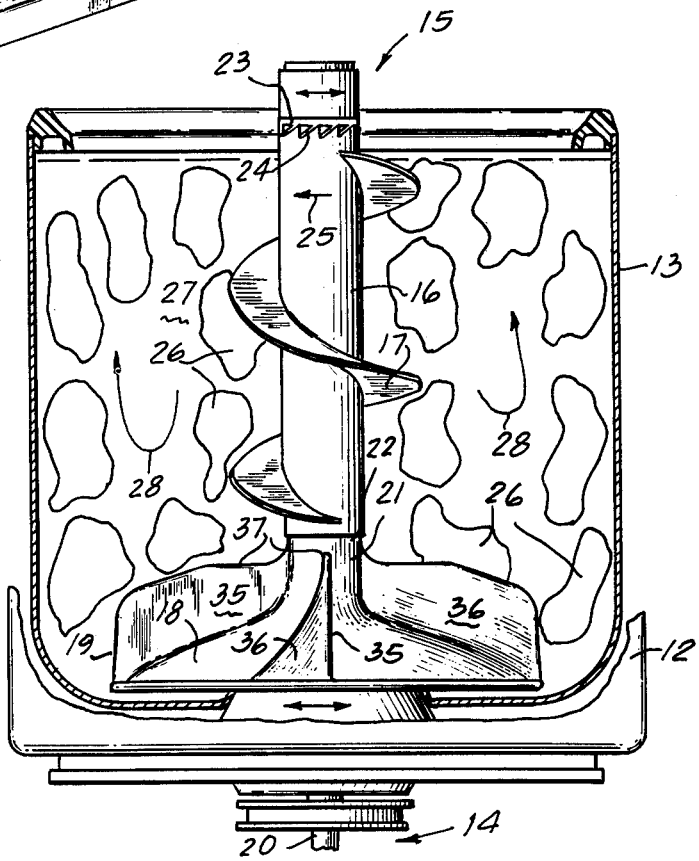
FIG. 2 is a side view of the clothes receptacle, with the cabinet and tube cut away and the basket in cross-section, and showing the agitator assembly of the present invention in elevation.
Figure 3:
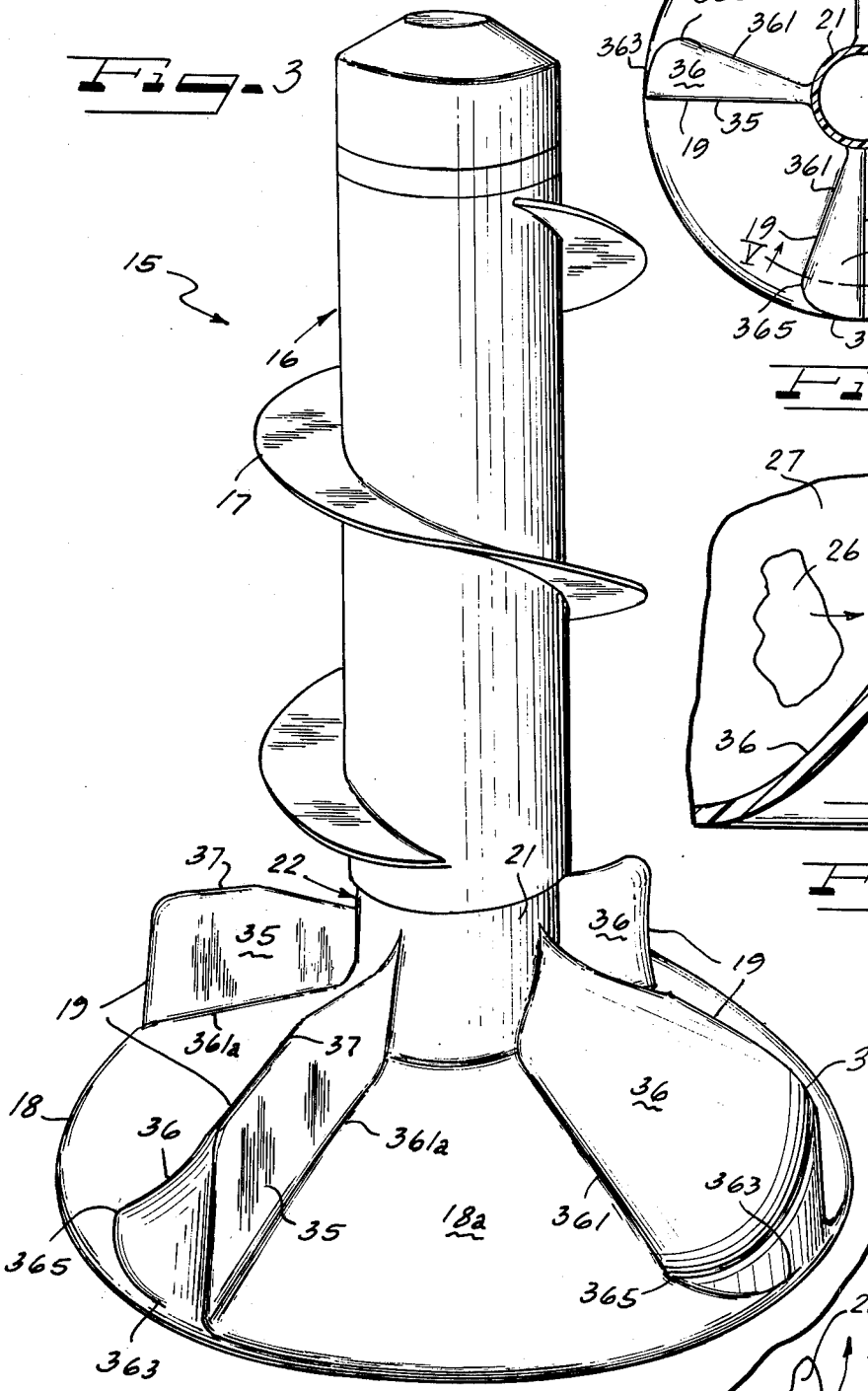
FIG. 3 is an enlarged perspective view of the agitator assembly of the present invention.

In FIG. 2, the agitator of the present invention is shown in operation with a load of laundry including fabric and clothing. The drive and transmission means 14 during the washing cycle oscillatably drives a vertically-disposed drive shaft 20 which is coaxial with the agitator assembly and drives the center post or barrel portion 21 of the agitator member 22 and one-way clutch means here shown as including a ratchet 23. This aspect of the structure and operation of the agitator assembly (i.e. the interrelationship of the agitator member including the skirt portion, the auger member, the one-way clutch means, and the drive shaft) is described in detail in U.S. Pat. Nos. 3,987,651 (Platt) and 3,987,652 (Ruble), assigned to the assignee of the present invention, and the descriptions from those patents are incorporated herein by reference. In the particular arrangement shown in FIG. 2 the one-way clutch means will drive the auger primarily in a second or clockwise direction, as indicated by the arrow 25. Where the clothes load is not large enough to sufficiently resist auger rotation in the first or counter-clockwise direction the auger member will tend to oscillate with the skirt portion, and even when the auger is not oscillating there will tend to be some slippage in the one-way clutch means allowing very limited auger movement in the first direction.

The radially-extending, helical vane 17 forms a counter-clockwise descending spiral about the outer portion of the auger member 16. Upon rotation of the auger 16 in a clockwise direction, articles of clothing or other items to be laundered 26 suspended in a supply of laundering liquid 27 will be moved downwardly adjacent the auger 16 by the action of the helical vane 17.

The skirt portion 18 of agitator member 22, being integral with the barrel portion 21, oscillates with successive clockwise and counter-clockwise movements. The scrubbing vanes 19 affixed to the skirt 18 along its upper surface 18*a* scrub the articles of fabric and clothing 26 passing adjacent thereto and tend to drive them radially outwardly along the bottom region of the clothes receptacle 13. The downward flow of articles 26 and washing liquid 27 created by the auger 16 combines with the radial movement caused by the oscillation of the scrubbing vanes 19 to impart a substantially toroidal movement pattern to the washing fluid 27 and articles 26 in the the receptacle 13. Thus the substantially toroidal movement pattern of the clothes in the receptacle is generally along a path downwardly along the central region of the receptacle, outwardly along the lower basket region, upwardly along the peripheral regions of the receptacle, and inwardly along the upper region of the receptacle, as suggested by the arrows 28,28. This movement pattern is substantially continuous throughout the washing cycle during periods when the agitator assembly is operating and may also be referred to as roll-over of the fabric and clothing.

In addition to the substantially toroidal movement 28 of the articles 26 and the laundering liquid 27, the auger 16 tends to induce rotational movements of clothes or other articles about the vertical axial center of the receptacle 13. In addition, conventional oscillating agitators with symmetric scrubbing vanes will generally impart some net rotation of this kind to the contents of a washing tub if the agitator exhibits unequal accelerations in opposite angular directions, the acceleration characteristics depending primarily on transmission geometry. Having the auger 16 rotate in the angular direction opposite to that of the above-described net rotation caused by the oscillating skirt portion will reduce the net rotation of receptacle contents which would otherwise be caused by the auger, but to only a limited extent.

Figure 4:
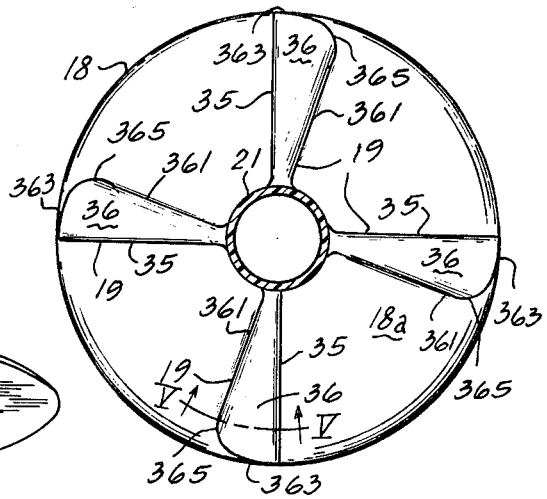
FIG. 4 is a plan view of the skirt portion of an agitator having four scrubbing vanes, showing the relation between the vertical faces and the ramped surfaces of the vanes.

In accordance with the principles of the present invention, the scrubbing vanes 19 affixed to the oscillating skirt 18 are each made asymmetric. On each vane 19*a* generally vertical pumping surface or vertical face 35 rising abruptly from the skirt 18 is provided facing opposite the direction of rotation of the auger 16, and a non-pumping surface or ramped face 36 is provided facing generally in the same direction as the direction of auger rotation (see FIG. 2). The ramp 36 extends smoothly from a line 361 defined along the upper surface 18*a* of the skirt portion 18 circumferentially and upwardly to form the ramp surface 36 which merges with an upper edge 37 of the vane 19 at the top of the vertical face 35 as shown in detail in FIGS. 3, 4, 5 and 6. As shown in FIG. 4, the line 361 may define a somewhat irregular curve which terminates at the peripheral surface of the barrel portion 21, where the ramp surface 36 is narrowest.

In the illustrated embodiment of the invention the line 361 extends generally radially outwardly in a direction such that the ramp surface 36 becomes increasingly wider as it approaches the radially outermost portion of the skirt 18. The ramp surface 36 is widest at the point 365 and thereafter becomes narrower as line 361 approaches the point 363 at the outer perimeter of the skirt. The position of the line of attachment or merging line 361 between the ramped surface 36 and the upper surface 18*a* of the skirt as well as the cross-sectional configuration defined by the inclined surface 36 of each vane 19 are selected to allow the clothes 26 and washing fluid 27 to slip upwardly and over the vane on each clockwise stroke of the skirt portion 18. Thus the ramp surfaces 36 are effective to minimize the pumping effect from the vanes 19 for movements of the skirt portion 18 in the clockwise direction.

The vertical face or surface 35 of each vane 19 extends upwardly from a line 361*a* defined on the surface 18*a* (see FIG. 3) in a substantially perpendicular direction relative to the upper surface 18*a* of skirt portion 18 with the two surfaces 35 and 36 intersecting along the edge 37.

Figure 5:
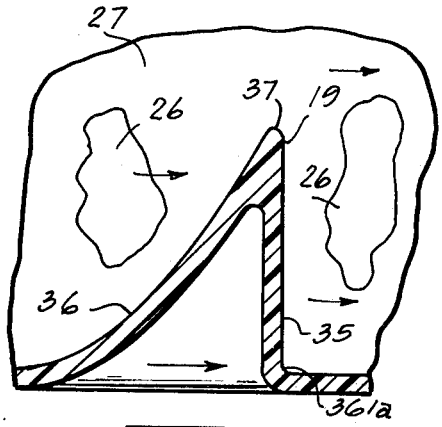
FIG. 5 is a fragmentary cross-sectional view taken on line V—V of FIG. 4, and indicates the operation of a ramped scrubbing vane during the counter-clockwise portion of an oscillation of the skirt, wherein the vertical face of a vane moves articles being laundered in a counter-clockwise direction.
Figure 6:
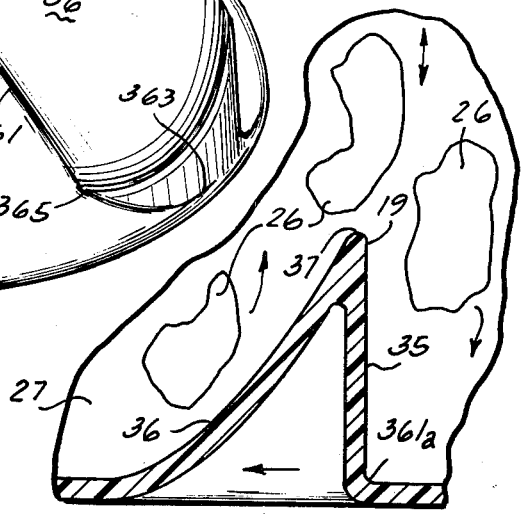
FIG. 6 is a view similar to FIG. 5 but indicating movement of the ramped scrubbing vane in the clockwise direction, wherein the ramped surface allows articles being laundered to slip up, slide over and behind the vane rather than forcing them in a clockwise direction.

The vertical surface 35 of each vane 19 faces in a direction generally opposite to the direction of rotational movement of the auger, and each of these surfaces 35 tends to pump or push adjacent clothes with each counter-clockwise stroke of the skirt portion 18 in a direction counter to the direction of auger rotation (see FIG. 5).

Thus as the skirt 18 oscillates, the ramped vanes tend to impart a net rotational movement to the clothes adjacent thereto. During the counter-clockwise stroke of the oscillating agitator the vertical face 35 pushes clothes in a first or counter-clockwise direction, but during the clockwise stroke the clothes tend to slide along the ramp surface 36. Therefore, a net counter-clockwise rotation is imparted by the ramped scrubbing vanes to the items in the lower portion of the basket, tending to oppose or counteract the clockwise rotation of clothes in upper basket regions caused by clockwise rotation of the auger. As a result, the net rotation of the entire basket contents, and hence tangling, is minimized.

The profiles shown generally in FIGS. 2, 3, 4, 5 and 6 show the ramp surface or inclined surface 36 disposed at an angulation in the order of about 45° from the upper surface portion 18*a* of skirt 18, there being a smooth curved transition area adjacent the line 361. Such exemplary profiles have been determined to give very good results in providing roll-over of the clothing 26 in the receptacle 13 while minimizing the net rotation of the clothes about the agitator axis.

In operation, after the clothes receptacle 13 is filled with washing fluid and the fabric or articles of clothing 26 placed therein, the drive and transmission means 14 will be activated, driving the agitator member 22 in oscillations clockwise (movement in a second rotational direction) and counter-clockwise (movement in a first rotational direction), and driving the auger portion 16 in a stepwise, clockwise rotation through the one-way clutch means. As the auger rotates, the helical vane 17 will urge the articles 26 in a clockwise direction. The asymmetric scrubbing vanes 19, oscillating with the skirt portion 18, will urge the articles 26 in a net counter-clockwise rotational direction in the receptacle 13.

On the clockwise oscillatory stroke, the articles 26 will be urged somewhat in a clockwise direction but some of the articles 26 and fluid 27 will flow upwardly under the influence of the ramped surface 36 and over the edge 37 of each vane 19 and will not be rotated clockwise the full extent of the clockwise oscillation of the skirt 18. Various numbers and configurations of scrubbing vanes 19 may be provided, depending on the size of the machine and other parameters. Thus, with the present invention and with regard for the oscillatory acceleration characteristics of the transmission means 14 and the design of the helical vane 17, minimum net rotation of the articles 26 in the receptacle 13 is obtained. Such minimal rotation will minimize objectionable tangling of fabric and improve the washability, uniformity of washability, and shaft torque characteristics of the machine during the wash cycle.

Although other various and minor modifications might be suggested by those versed in the art, it should be understood that I wish to embody within the scope of the patent warranted hereon all such modifications as reasonably and properly come within the scope of my contribution to the art.

The embodiments of the invention in which an exclusive property or privilege is claimed are defined as follows:

1. In a washing machine having a washing receptacle for containing liquid and articles to be laundered, a vertical axis agitator assembly mounted within said receptacle and comprising:

an auger member movable primarily in one rotational direction about said axis within said receptable and having helical vane means for urging articles generally downwardly adjacent the agitator upon unidirectional rotation thereof, the rotation of the auger inducing a rotation of the receptacle contents about the agitator axis;

an agitator member mounted for oscillation about said axis in opposite rotational directions and including a skirt portion having a plurality of radial scrubbing vanes extending generally upwardly therefrom and carried thereby; and drive means for oscillating said agitator member and rotating said auger member primarily in one rotational direction, said scrubbing vanes each having one substantially vertical surface extending in the radial direction and one ramp surface opposed thereto, the vertical surface facing opposite to the direction of rotational movement of the auger portion, and the ramp surface facing in the same direction as the direction of rotation of the auger portion, to limit the rotation imparted to the articles being washed by the auger upon oscillation of the skirt portion in the same direction, thereby to provide substantially toroidal movement of the articles being laundered with minimal net rotation about the agitator axis.

2. In a washing machine as defined in claim 1, wherein the drive means includes a transmission having different acceleration characteristics for the two rotational directions of each oscillation, these characteristics tending generally to rotate the receptacle contents in a first direction about the agitator axis, said first direction being opposite to the direction of rotation of the auger, thereby to further minimize net rotation of the receptacle contents about the agitator axis.

3. In a washing machine of the vertical axis type wherein the agitator assembly has an auger member rotatable in one direction and an oscillating agitator member including a skirt portion with radial scrubbing vanes affixed thereto, the scrubbing vanes each characterized by:

a substantially vertical face facing in a direction opposite to the direction of rotation of the auger; and a ramped face opposite the vertical face and smoothly connecting the upper surface of the skirt portion and an upper, generally radially-extending edge of the vertical face, thereby to reduce the tendency of the agitator assembly to rotate wash liquids an items being washed circumferentially about the agitator axis and to reduce tangle of said items being washed.

4. In a washing machine having a washing receptacle for containing wash liquid and items to be washed, a vertical axis agitator assembly comprising, in combination:

an auger portion having a radially-disposed helical vane and driven about it axis primarily in one direction, a skirt portion mounted below the auger portion and driven oscillatingly about said axis, transmission means providing different acceleration characteristics to the skirt in its opposite directions of oscillation; and a plurality of radial scrubbing vanes affixed to said skirt portion and rising upwardly from an upper surface of the skirt portion, each vane characterized by:

a generally vertical face extending from a first line on the upper surface of the skirt to an upper edge and facing opposite the direction of rotation of the auger, and a ramped face extending from a second line on the surface of the skirt spaced from said first line in the direction of rotation of the auger, upwardly and circumferentially from said second line to an upper portion of the vane.

5. In a washing machine as defined in claim 4, wherein the transmission means acceleration characteristics produce a rotation of the items to be washed opposed to the direction of rotation of the auger.

6. An agitator assembly for a vertical axis washing machine having an auger portion to be driven in unidirectional rotation and a skirt portion to be oscillated about the axis of rotation of the auger, the skirt portion including asymmetric, ramped scrubbing vanes affixed thereto and each comprising:

a vertical face opposed to the direction of rotation of the auger portion; and a ramped surface facing in the direction of rotation of the auger portion, whereby rotational movement imparted to the basket contents in a machine by the auger portion may be substantially counteracted by an opposite rotation induced in wash liquid by the asymmetry of the scrubbing vanes during oscillation in a machine.

7. An agitator assembly as defined in claim 6, wherein the vertical faces of the vanes face in the same direction as the rotation induced by differing acceleration characteristics imparted to the scrubbing vanes by a drive means of the machine in oscillating clockwise versus counterwise.

8. An agitator assembly as defined in claim 6, wherein said vertical face further comprises a vertical wall rising abruptly from said skirt portion and adapted to pump wash liquid when moved therein.

9. An agitator assembly as defined in claim 6, wherein said ramp surface further comprises an inclined wall rising gradually from said skirt portion and adapted to lift wash liquid and articles suspended therein upwardly and over the vanes.

10. An agitator assembly as defined in claim 6 wherein said ramped surface merges with said skirt portion on a line defining an irregular curve extending radially outwardly toward an outer peripheral edge of said skirt portion, said vanes becoming successively wider along the length of said line.

11. An agitator assembly as defined in claim 10, said ramped surface in cross section being disposed at an angulation in the order of about 45° from an adjoining surface of the skirt portion and joining said skirt portion in a smooth, curved transition area.

12. For use in a laundry appliance, agitator means comprising:

a vertical centerpost adapted to be oscillated on a vertical axis;

a skirt extending radially outwardly from a lower portion of said centerpost;

a plurality of upright vanes spread circumferentially from one another and extending above said skirt;

impelling means above the level of said skirt and said vanes to direct laundry articles toward said vanes;

each said vane having a perpendicular wall on one face rising abruptly from said skirt and adapted to pump fluid when moved therein;

the opposite face of each said vane comprising a ramp rising gradually from said skirt and adapted to lift articles and liquid over the vane during a fabric washing operation;

said opposite face of each said vane being characterized by said ramp merging with said skirt on a line defining an irregular curve intersecting said centerpost generally coincident with said perpendicular wall and extending radially outwardly toward the outer peripheral edge of said skirt, said ramp becoming sucessively wider along the length of said line;

said ramp profile in cross section being disposed at an angulation on the order of about 45° from the adjoining surface of the skirt and joining said skirt in a smooth curved transition area; and said agitator means being adapted for use with drive means for driving said auger impelling means rotationally and said skirt and vanes oscillatably, said ramp being formed on the side of the vane opposite to the rotational direction of the auger means.

13. In a washer, an agitator, a receptable for containing washing liquid and items being washed, and drive means for driving said agitator, said agitator comprising:

an agitator member adapted for mounting within said receptacle and for oscillation by said drive means in a first and second rotational direction, said agitator member including an upper center post portion and a lower skirt portion carrying a plurality of scrubbing vanes at least one of which defines a pumping surface facing said first direction and a non-pumping surface facing said second direction, and an auger member mounted coaxially on said center post portion for unidirectional rotation by said drive means in said second direction to move items being washed downwardly therealong towards said skirt portion, whereby the combined effect of said oscillating scrubbing vanes and said unidirectionally rotating auger is to minimize the net rotation of said items being washed about the axis of said agitator.

14. In a washer as claimed in claim 13 wherein said pumping surface of said vane comprises a substantially vertical surface facing said first rotational direction and said non-pumping surface of said vane comprises a ramp surface extending from said skirt portion to an upper portion of said vane, said vertical surface of said vane providing a pumping action in said first rotational direction and said ramp surface minimizing any pumping action in said second rotational direction.

15. In a washer as claimed in claim 13 wherein rotation of said auger is in incremental steps coinciding with the oscillatory movements of said skirt portion in said second direction and said pumping surface of said vane provides a pumping action in response to oscillatory movements of said skirt portion in said first direction, said non-pumping surface of said vane minimizing pumping action in response to oscillatory movements of said skirt portion in said second rotational direction.

* * * * *